US007420518B2

(12) United States Patent
Boisbouvier et al.

(10) Patent No.: US 7,420,518 B2
(45) Date of Patent: Sep. 2, 2008

(54) PLANAR ANTENNA WITH MATCHED IMPEDANCE AND/OR POLARIZATION

(75) Inventors: Nicolas Boisbouvier, Rennes (FR); Philippe Minard, Saint Medard sur Ille (FR); Ali Louzir, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 120 days.

(21) Appl. No.: 11/287,999

(22) Filed: Nov. 28, 2005

(65) Prior Publication Data

US 2006/0152425 A1 Jul. 13, 2006

(30) Foreign Application Priority Data

Dec. 13, 2004 (FR) ..... 04 52948

(51) Int. Cl.
*H01Q 13/12* (2006.01)

(52) U.S. Cl. ..... 343/769; 343/767

(58) Field of Classification Search ..... 343/767, 343/769

See application file for complete search history.

(56) References Cited

U.S. PATENT DOCUMENTS 2,977,595 A * 3/1961 Zisler et al. ..... 343/769
7,227,507 B2 * 6/2007 Minard et al. ..... 343/767

FOREIGN PATENT DOCUMENTS

| | | |
|---|---|---|
| EP | 1 367 673 A1 | 12/2003 |
| GB | 1 546 571 A | 5/1979 |
| RU | 1 775 757 A1 | 11/1992 |

OTHER PUBLICATIONS

Japan Abstract 05267923; published Oct. 15, 1993; Kokusai Kagaku Shinko Zaldan; vol. 16, No. 038.

Dual-Loop Slot Antenna With Simple Feed; Stevenage, Herts; Electronics Letters; pp. 1218-1219; vol. 25, No. 18; Aug. 31, 1989.

Search Report dated May 11, 2005.

* cited by examiner

*Primary Examiner*—Michael C Wimer
(74) *Attorney, Agent, or Firm*—Joseph J. Laks; Robert D. Shedd; Brian J. Cromarty

(57) ABSTRACT

The present invention relates to a planar antenna carried by a substrate comprising a slot in the form of a closed curve dimensioned to operate at a given frequency, supplied by a feeder line intersecting the slot at a point known as an excitation point, characterized in that at least two short circuits in parallel on the slot are positioned with respect to the excitation point so as to match the impedance to the excitation point and/or the polarization of the antenna.

6 Claims, 4 Drawing Sheets

Elevation Pattern Directivity Display (dBi)
f = 5.25 (GHz)

Elevation Pattern Directivity Display
(dBi)

PLANAR ANTENNA WITH MATCHED IMPEDANCE AND/OR POLARIZATION

FIELD OF THE INVENTION

The present invention relates to a planar antenna carried by a substrate comprising a slot in the form of a closed curve dimensioned to operate at a given frequency, supplied by a feeder line intersecting the slot at a point known as an excitation point.

BACKGROUND OF THE INVENTION

Such antennas are suitable for local wireless networks. Classically, the slot, for example annular, is excited by electromagnetic coupling to a microstrip line according to KNORR dimensioning rules.

With such an excitation, the impedance in the electrical plane corresponding to the excitation point typically lies between 300 and 400 Ohms depending on the parameters of the substrate and the slot. Hence, this type of supply requires an impedance transformer to reduce the impedance for an adaptation at 50 Ohms or at more common impedance values. This impedance transformation, for example on a quarter wave basis, is cumbersome, generates line loss and leads to a reduction in bandwidth.

Moreover, with this type of excitation, the polarization is linear and its direction is imposed by the excitation point. It is therefore necessary to change the excitation point to modify the polarization direction.

BRIEF SUMMARY OF THE INVENTION

This invention proposes a planar antenna that can vary the impedance at the excitation point and/or modify the polarization direction.

The present invention relates to an antenna such that at least two short circuits in parallel on the slot are positioned with respect to an excitation point so as to match the impedance at the excitation point and/or the polarization of the antenna.

Indeed, according to the invention, it is noted that selecting the relative position of the feeder line and of two short circuits placed on the slot allows the impedance value at the excitation point of the slot to be modified and/or the polarization direction of an antenna to be modified.

In a first embodiment, the short circuits remain fixed and the position of the excitation point is modified to match the impedance to the excitation point.

Indeed, it is noted that changing the position of the excitation point enables the impedance at the excitation point to be modified. When the short circuits are fixed, it is also noted that the modification of the impedance does not modify the polarization of the antenna. In fact, it is the short circuits that impose the polarization.

In a second embodiment, the excitation point remains fixed and the positions of the short circuits are modified to change the polarisation.

In this case, the polarization of the antenna can be modified. However, it should be noted that this generally causes a modification of the impedance at the excitation point.

In a specific embodiment, the slot presenting an axis of symmetry perpendicular to the plane on which it is located four short circuits arranged, around the axis, at 90° from each other on the slot, are activated by pairs of diametrically opposed short circuits, to provide the antenna with two separate polarizations.

Advantageously, the feeder line is then positioned at 45° from one of the short circuits.

Indeed, in this case, the impedance is the same for both polarizations, not requiring an additional impedance transformer.

In one embodiment, the slot presenting an axis of symmetry perpendicular to the plane on which it is located, the two short circuits are geometrically opposite on the slot with respect to this axis, thus defining a short circuit plane.

According to the invention, the slot can be annular or square or rectangular or polygonal and the short circuits can be created by means of switching devices, for example diodes.

The invention also relates to a method for manufacturing a planar antenna comprising the step of positioning at least two short circuits (SC) in parallel on the slot (F), the position with respect to the excitation point (E) of the short circuits being selected so as to match the impedance to the excitation point (E) and/or the polarization of the antenna.

BRIEF DESCRIPTION OF THE DRAWINGS

Other characteristics and advantages of the present invention will emerge on reading the description of different embodiments, the description being made with reference to the annexed drawings wherein.

DESCRIPTION OF PREFERRED EMBODIMENTS

Figure 1:
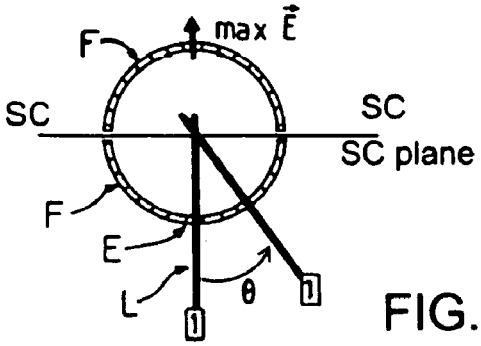
FIG. 1 is a diagram of a planar antenna according to the invention and illustrates a first application of the invention.

FIG. 1 shows an antenna according to the invention. This antenna is placed on a substrate corresponding to the plane of the sheet. It comprises a slot F with a closed curve form, here a ring. It is dimensioned to operate at a given frequency and fed by a feeder line L intersecting the slot F at an excitation point E. More specifically, the perimeter of the annular slot is chosen to be equal to λs, where λs is the guided wavelength in the slot. According to the invention, the slot comprises two short circuits SC, arranged in parallel and diametrically opposed on the annular slot F. They are positioned with respect to the excitation point so as to adjust the impedance at the excitation point. This adjustment is explained hereafter.

It is known that the coupling conditions are optimal in such antennas when the line is perpendicular to the plane defined by the short circuits, as in this case the physical short circuits coincide with the short circuits induced by the line. In FIG. 1, when the excitation point is displaced by moving the feeder line relative to both short circuits by an angle θ, the impedance at the excitation point is modified.

The moving of the feeder line, for example, simply carried out by a plurality of feeder lines arranged around one of the semi-circles of the slot F and activated if necessary when the impedance is required to be modified.

The invention can also be implemented for applications where the required impedance is fixed and where, a single line is consequently arranged with an angle θ adapted according to the required impedance.

According to the invention, the coupling conditions between the slot and the line are therefore degraded with respect to the optimal conditions. However, the coupling equation C=E ˆ H is not null as long as the excitation point is not on an imposed short circuit point of the slot. Indeed, the field E results from the configuration of slot F and the field H results from the configuration of the line L. By moving the line L by an angle θ, the value of C is therefore reduced without cancelling it out and enables the impedance to be matched. It is thus possible to have variable impedances on the excited half-ring according to the position of the excitation point. The maximum of this impedance is encountered when the coupling conditions are maximum, namely, when the line is placed in the middle of the half-ring.

The field distribution in the half-rings is imposed by the short circuits.

Figure 2A:
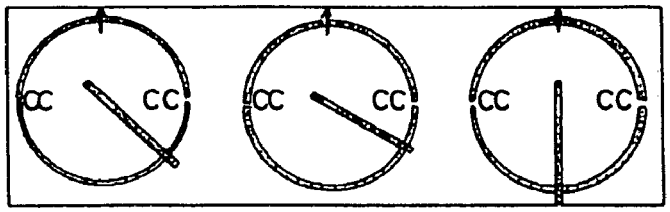
FIGS. 2*a* and 2*b* show the orientation of the polarization, respectively in an antenna according to the invention and in an antenna according to prior art.
Figure 2B:
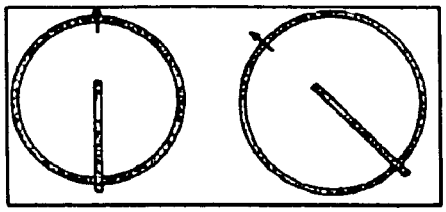
Figure 3A:
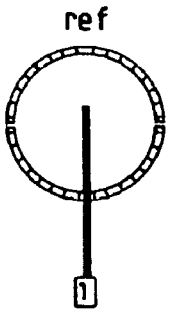
FIGS. 3*a*, 3*b*, 3*c*, 3*d*, 3*e* show various excitation point positions of the slot with respect to the short circuits.
Figure 3B:
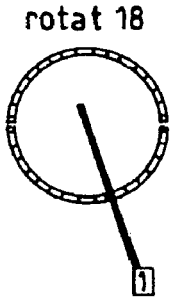
Figure 3C:
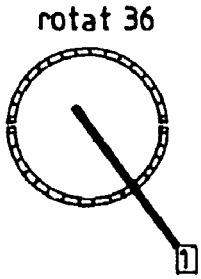
Figure 3D:
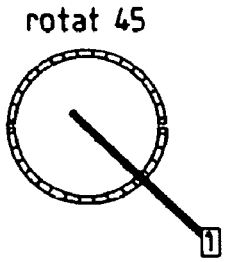
Figure 3E:
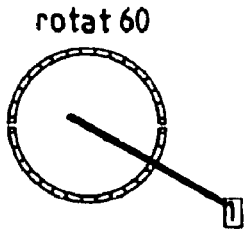

FIG. 2 shows the current distribution and the resulting polarization in the slots of various embodiments of planar antennas according to the invention (FIG. 2*a*) and according to prior art (FIG. 2*b*). It is noted in FIG. 2*a* that the polarization remains stable by modifying the position of the excitation point whereas it turns with the feeder line when the slot does not have any short circuit, as well as shown in FIG. 2*b*.

Hence, the use of at least two short circuits on the slot enables the slot to impose the polarization. Indeed, contrary to what happens for a standard slot not comprising any short circuit or comprising a single short circuit, the direction of linear polarization does not turn according to the position of the excitation point and is imposed by the short circuits. The polarization is therefore perpendicular to the plane of the short circuits, wherever the excitation point is located.

FIG. 3 shows antennas presenting five distinct positions of the excitation point according to the principle of realization shown in FIG. 1. On these antennas, two diametrically opposed short circuits are arranged on the annular slot. Two half-rings of length Ls/2 are thus facing each other.

In practice, these antennas are simulated with a dimensioning to operate at 5.8 GHz on a dielectric substrate of type Rogers4003 (Er=3.38, h=0.81 mm). The perimeter of the annular slot must be in the order of the guided wavelength in the slot (Ls) namely a radius of 6.65 mm.

Figure 4:
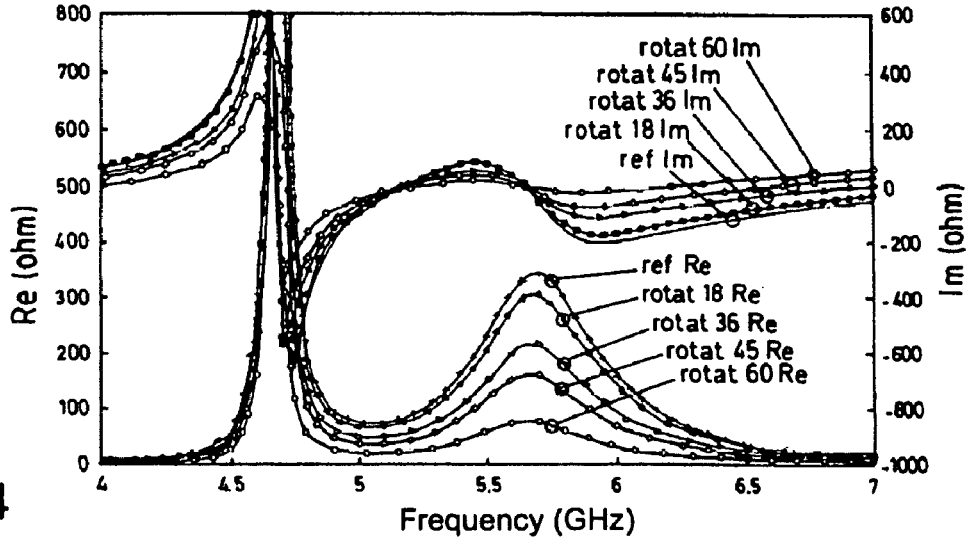
FIG. 4 shows the impedance presented by the slot according to the position of the excitation point as shown in FIGS. 3*a* to 3*e*.

The impedances of the different antenna are shown in FIG. 4. The values of the impedances range from 350 Ohms for the position of the line at 90° from the short circuits down to values less than 70 Ohms for the position at 60°, for example. These results confirm the interest of the invention for matching the impedance of the antenna and show the possible extent of the impedance matching.

Figure 5:
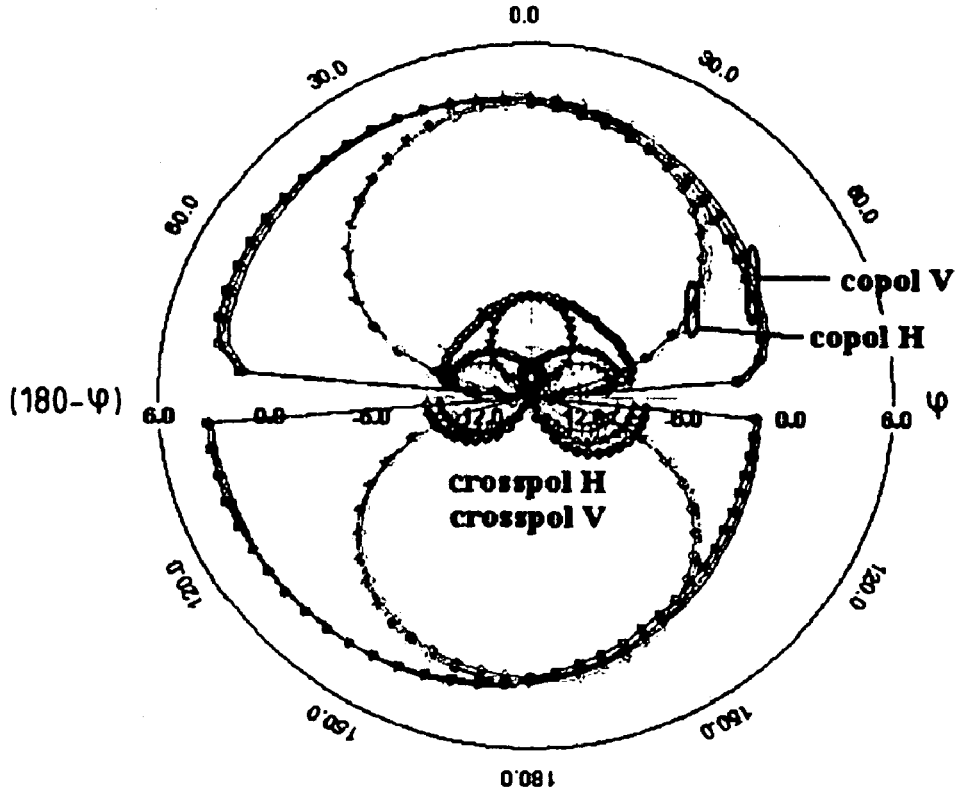
FIG. 5 shows the levels of copolarization and crosspolarization of the annular slot according to the excitation point.

FIG. 5 shows the four components of the field E in the planes H and V, defined respectively by the short circuits plane and the plane perpendicular to the short circuits plane, for the embodiments of FIG. 3. It is noted that irrespective of the position of the excitation point, the main component remains omnidirectional (directivity in the order of 3 dB) and the crosspolarization levels are much lower than the copolarization levels (at least 10 dB). This figure confirms that a linear polarization is preserved when there is a shift from the standard maximum coupling position.

A specific embodiment has been more specifically studied. In this embodiment shown in FIG. 6, the antenna 2 comprises two diametrically opposed short circuits and an excitation point at 51° from the reference position. The impedance presented is then around 50 Ohms and can therefore be matched directly on this impedance value. This means that it is unnecessary to extend the line far from the outer side of the slot, as is the case for the standard antenna 1 also shown in FIG. 6. Hence, it is noted that with a standard antenna 1 where the line is at 90° to the short circuits plane, the size of the ground plane, with hatching, required to obtain such an impedance is 30×35 mm2 whereas with the invention, as the impedance matching is realized by other means than a longer length of line, the necessary size is only 30×27 mm2. The invention thus provides a saving in compactness.

Figure 6:
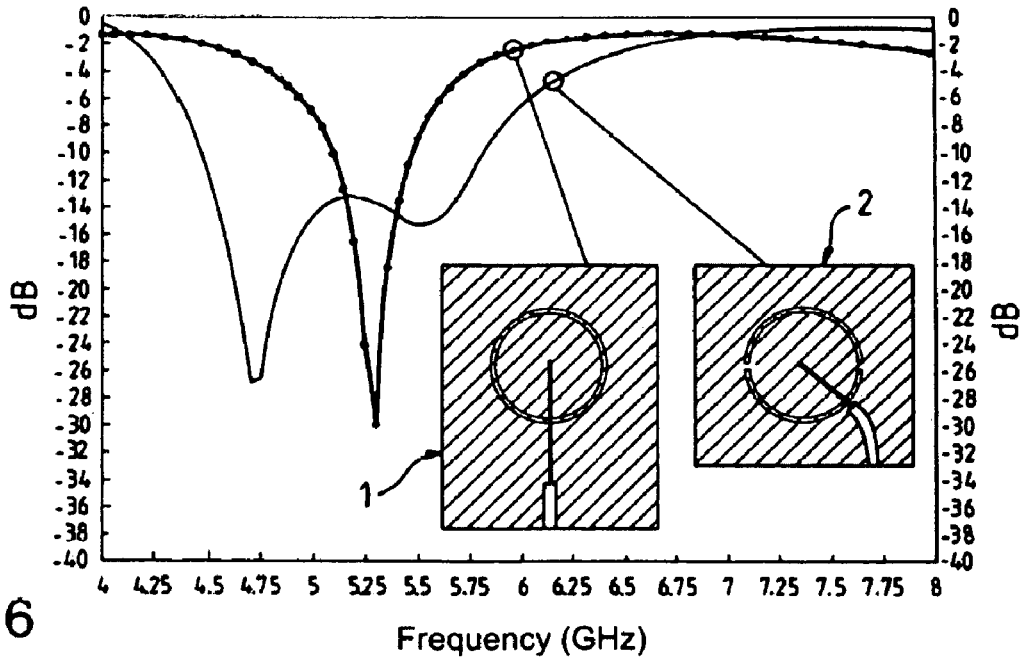
FIG. 6 shows the bandwidth for a specific embodiment of an antenna according to the invention shown in FIG. 2*a*(i) and for an antenna according to the prior art, shown in FIG. 2*b*.

FIG. 6 also shows that the bandwidth at −10 dB is wider. So the bandwidth is 23.1% for antenna 2 against 7% for the standard antenna 1.

Figure 7:
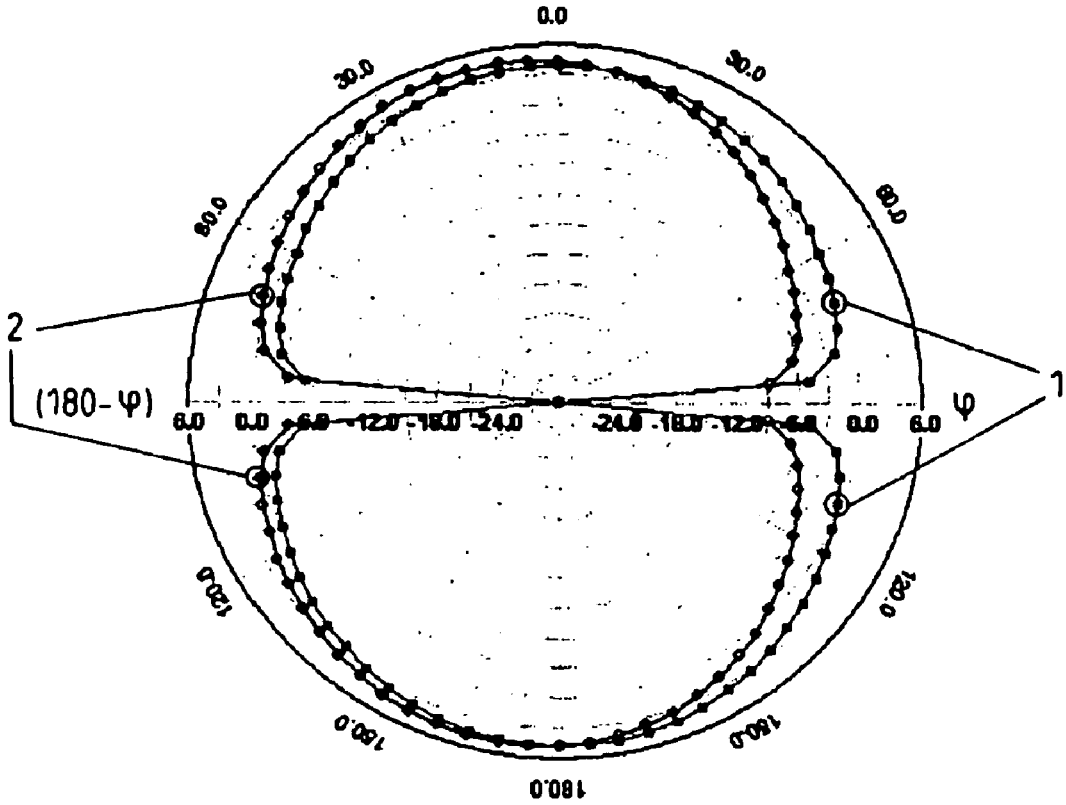
FIG. 7 shows the radiation patterns for a specific embodiment of an antenna according to the invention shown in FIG. 2*a*(i) and for an antenna according to the prior art, shown in FIG. 2*b*.

FIG. 7, showing the radiation patterns, shows that the radiation pattern is however only slightly modified when the excitation point is moved.

Figure 8:
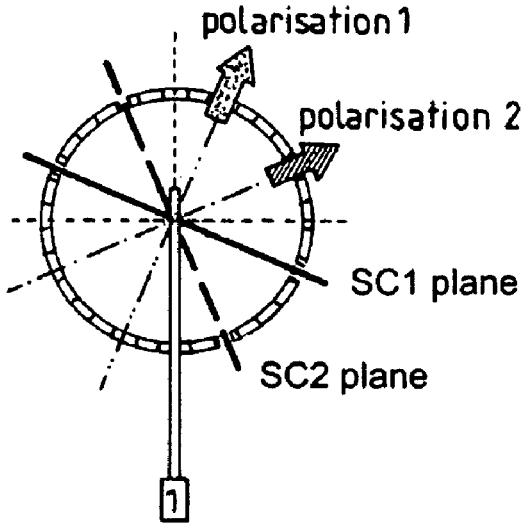
FIG. 8 is a diagram of a planar antenna according to the invention and illustrates a second application of the invention.

FIG. 8 shows a planar antenna according to the invention in which the excitation point E is maintained fixed while the short circuit positions SC1 and SC2 are modified. In this case, the polarization is turned with the short circuits plane.

The short circuits are implemented using diodes, for example. The diodes can advantageously operate in diametrically opposed pairs.

Figure 9:
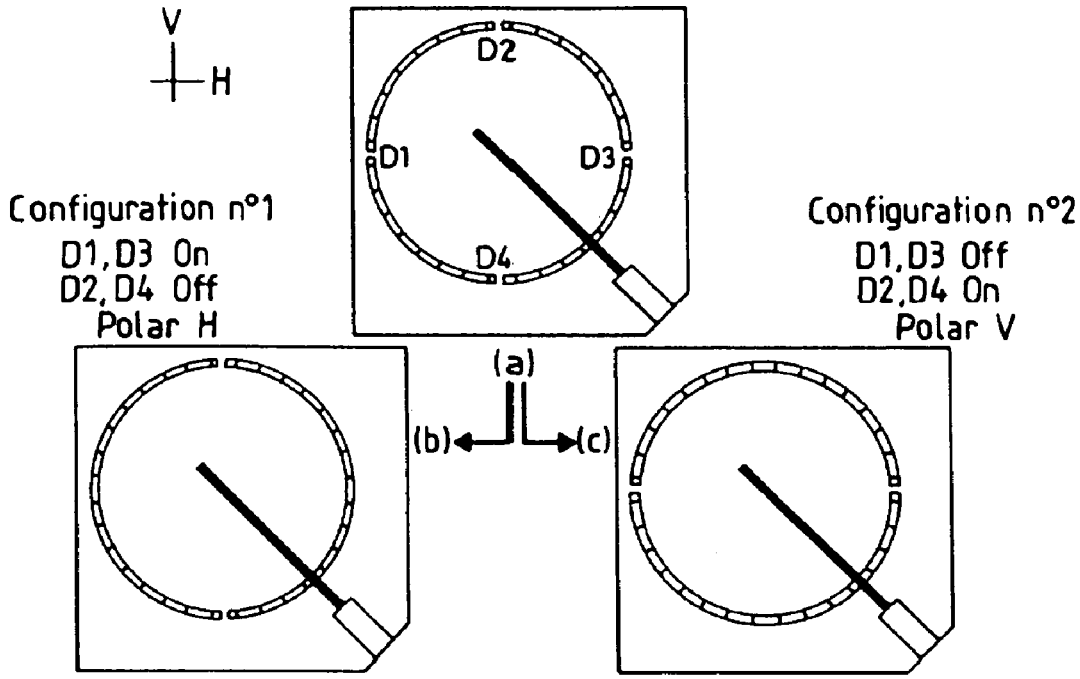
FIG. 9 shows a specific embodiment of the invention in which the antenna features two configurations, each one presenting a distinct polarization.

FIG. 9 shows an embodiment of a planar antenna showing a diversity of polarisation obtained according to the principle of the invention. In this embodiment, four diodes are arranged on the slot at 90° from each other. By switching the diodes opposite each other two by two, two states of linear polarization can be accessed by using a single excitation point. The excitation point position is selected at 45° from one of the short circuit planes to have the same impedance in both polarization states.

Figure 10A:
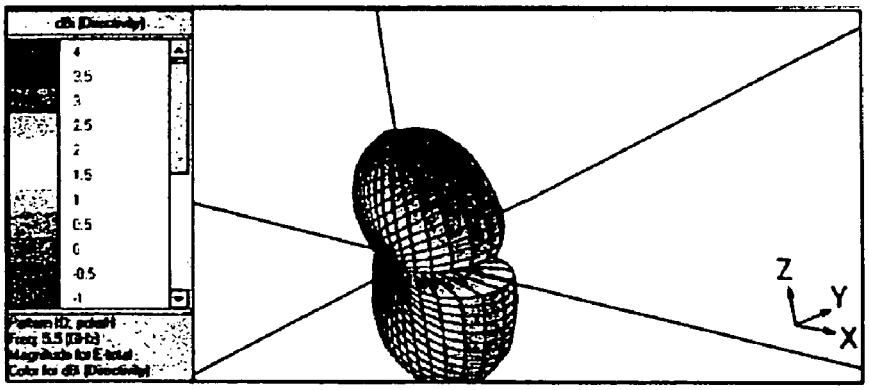
FIG. 10*a* and 10*b* show the radiation patterns for both configurations of the antenna in FIG. 9.

A first polarization state corresponding to a first configuration in which the diodes D1 and D3 are non-conducting, and diodes D2 and D4 conducting. The polarization is then horizontal as shown in the radiation pattern of FIG. 10*a*.

Figure 10B:
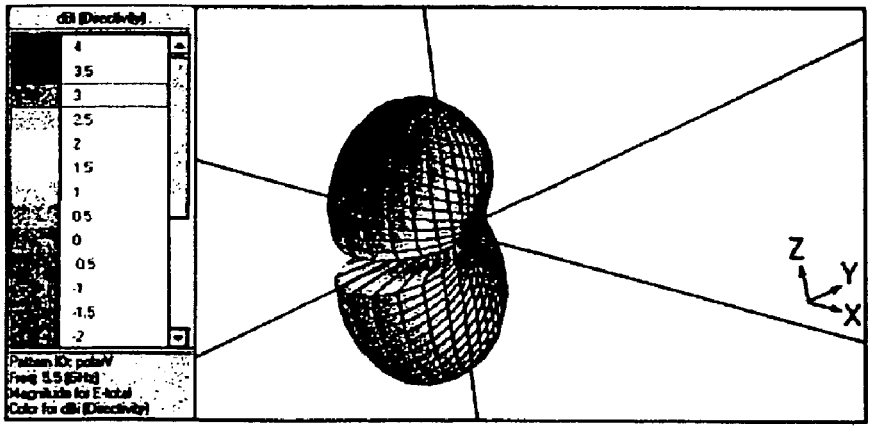

Conversely, the second polarization state corresponds to a second configuration in which the diodes D1 and D3 are conducting, and diodes D2 and D4 non-conducting. The polarization is then vertical as shown in the radiation pattern of FIG. 10*b*.

The description proposed here only comprised two pairs of diodes but the invention enables an antenna with polarization diversity in the order of n to be realized, n being the number of short circuit planes imposed in the slot.

Hence, the invention can obtain antennas enabling direct matching for any impedance. This means that the antenna is more compact since no impedance transformer is required, that the bandwidth is wider and that the structure presents reduced line loss.

The invention also enables polarization diversity antenna structures to be obtained. The polarization can be permutated by modifying the short circuit positions without changing the excitation point.

The invention is not restricted to the embodiments described and those skilled in the art will recognise the existence of diverse variants of embodiments as for example the use of other forms of closed curve slot (squares, polygonals, etc.), the use of diverse slot feed technologies (microstrip, tri-plate, coplanar and co-axial feed technology, etc.), the use of diverse active elements for switching from one state to another (diodes, transistors, MEMs, etc.), the use of the slot in its fundamental mode or higher order modes, the use of a plurality of short circuits not necessarily placed so as to define a diametrical short circuit plane, short circuit pair plane, etc.

What is claimed is:

1. A planar antenna carried by a substrate comprising a slot in the form of a closed curve dimensioned to operate at a given frequency, supplied by a feeder line intersecting the slot at a point known as an excitation point, wherein, the slot presenting an axis of symmetry perpendicular to said substrate, four short circuits are arranged on the slot around the axis at 90° from each other and are activated by pairs of diametrically opposed short circuits to provide the antenna with two separate polarizations.

2. Planar antenna according to claim 1, wherein the feeder line is arranged at 45° from one of the short circuits.

3. Planar antenna according to claim 1, wherein the slot is annular or square or rectangular or polygonal.

4. Planar antenna according to claim 1, wherein the short circuits (SC) are realized using switching devices.

5. Planar antenna according to claim 4, wherein the switching devices are diodes.

6. A planar antenna carried by a substrate comprising a slot in the form of a closed curve dimensioned to operate at a given frequency, supplied by a feeder line intersecting the slot at a point known as an excitation point, wherein, the slot presenting an axis of symmetry perpendicular to said substrate, two short circuits are arranged on the slot, said two short circuits being positioned on the slot to be diametrically opposed and thus defining a short circuit plane, the excitation point having with said short circuit plane an angle $\theta$ such that $0<\theta<90°$.

* * * * *